US005833361A

United States Patent [19]

Funk

[11] Patent Number: 5,833,361

[45] Date of Patent: Nov. 10, 1998

[54] APPARATUS FOR THE PRODUCTION OF SMALL SPHERICAL GRANULES

[76] Inventor: James E. Funk, 301 Maple Ave., Seneca, S.C. 29678

[21] Appl. No.: 524,601

[22] Filed: Sep. 7, 1995

[51] Int. Cl.[6] ..... B01F 7/42

[52] U.S. Cl. ..... 366/80; 366/88; 366/90; 366/307; 366/322; 366/323

[58] Field of Search ..... 366/64, 66, 80, 366/88, 90, 139, 303, 307, 322, 323, 324

[56] References Cited

U.S. PATENT DOCUMENTS

| | | | |
|---|---|---|---|
| 3,684,252 | 8/1972 | Nissle et al. | 366/90 X |
| 4,538,917 | 9/1985 | Harms | 366/324 X |

FOREIGN PATENT DOCUMENTS

| | | | |
|---|---|---|---|
| 1421061 | 11/1965 | France | 366/322 |
| 1251072 | 10/1971 | United Kingdom | 366/80 |

*Primary Examiner*—Charles E. Cooley
*Attorney, Agent, or Firm*—Howard J. Greenwald

[57] ABSTRACT

A mixer for delaminating, deagglomerating, mixing, and extruding a mixture of powder and liquid, which contains a mixing chamber, a variable speed rotating shaft disposed within the chamber, a multiplicity of stators extending from the interior wall of the chamber towards the shaft, and a multiplicity of differently configured auger blades connected to the shaft. The device contains a first, second, and third set of auger blades, each of which is connected to the shaft. The first set of augur blades has a pitch which is at least twice as great as the pitch of each of the second and third set of augur blades, and it also has a smaller face area.

1 Claim, 3 Drawing Sheets

APPARATUS FOR THE PRODUCTION OF SMALL SPHERICAL GRANULES

FIELD OF THE INVENTION

An apparatus for producing an extrudate which can be used in the plastic manufacture of proppants.

BACKGROUND OF THE INVENTION

The methods most commonly used for the manufacture of small spherical granules, such as proppants used for secondary oil and gas well recovery, commonly involve the steps of spray drying a clay slurry in a fluidized bed dryer, impact granulation of a calcined clay powder in a high shear mixer (such as an Eirich mixer) as it is wetted by water or slurry additions, or conventional spray drying. The first two processes produce poor microstructure in the granules before and after firing to maximum density which, degrades the potential strength available from the raw materials. The third process produces granules too small for use as proppants.

Most, if not all, ceramic raw materials and other fine powders are more or less severely agglomerated upon receipt at the processing plant. Some raw materials, such as clays as mined, are strongly laminated. These laminations result from the decomposition of feldspathic rock during its metamorphosis and recrystallization to the clay minerals. Such laminations are most common in kaolins used in many ceramic processes and in montmorillonites commonly used in oil drilling muds. Many manufactured refractory powders, such as aluminum oxide and electronic ceramic powders such as barium titanate and its numerous analogs, contain agglomerates of variable strength which cannot be easily deagglomerated down to their ultimate intrinsic particle size using conventional mixing equipment. The result is that these materials do not adequately or consistently provide the properties for which they were selected. It is the purpose of this invention that any such raw material should be reduced to its ultimate particle size during mixing with other ingredients to maximize its potential properties in use. The use of such raw material substantially improves its suitability for various processes.

Thus, e.g., for the spray drying processes it is necessary to "blunge" the solids with a liquid (such as water) at as high a solids loading as possible consistent with adequate flow of the suspension, using high shear mechanical energy to effect deagglomeration and mixing the powder, the water, and any chemical additions necessary to control the rheological properties of the suspension.

Plastic mixing, which occurs when the solids content and/or the viscosity of the mix is too high to impart fluidity for spray drying or casting, is effected by many devices on the market, none of which impart the energy necessary to properly deagglomerate, delaminate, and mix the powder, liquid, and chemical ingredients at a scale fine enough to utilize the intrinsic powder properties. The applicant has discovered that such high shear stresses at high shear rates are necessary to perform adequate mixing of a plastic powder mixture and to simultaneously provide both the maximum plasticity inherent in the materials and the optimum microstructure possible in the final product. A most important consideration of this apparatus and its process is to locate the mixing components, augers and stators, as close to each other as possible to prevent the agglomerates from escaping the very high shear stress environment necessary to delaminate and deagglomerate them.

Granulation, or pelletization, or spheroidization of powders are steps which are normally performed in a variety of ways.

Thus, one may utilize conventional spray drying of a suspension of the powders to a rather narrow granule size distribution. To maximize product microstructure, this method requires a very low viscosity suspension which produces granules too small to be useful as proppants.

Thus, one may utilize spray drying into a fluidized bed dryer containing seed materials usually taken from a dust collector. This method successively builds layers of material onto the seed similar to an onion skin and generally provides a poor granule microstructure.

Thus, one may utilize impact granulation using a high speed batch machine (such as an Eirich Mixer) where the powder is added to the mixer with a low moisture content which wets the powder just sufficiently to allow granulation. This method does not usually provide optimum microstructure unless there can be some intrinsic plastic component in the powder, or an addition (such as carboxymethylcellulose or the like) to impart some plasticity.

For impact forming, a slight amount of plastic deformation is necessary to produce adequate microstructure. When properly used, this method can produce good granules but often they may need to be rolled to improve their sphericity.

Thus, e.g., one may use rotating disc granulation (as is used by the Mars Minerals Company of Mars, Pa.) which granulates dry powders with controlled additions of moisture as the powders are rotated on a tilted disc. These granules are usually too large for use as proppants, and they are very poorly compacted with a concomitant poor microstructure. Such granules are commonly produced for easy dissolution of fertilizers and pesticides in water where the openness of the microstructure enhances their dissolution rate.

Thus, e.g., one may utilize extrusion and granulation, as performed by the LCI Corporation of Charlotte, N.C. This process uses a poor mixer to extrude a soft plastic body through a multiplicity of very short orifices in the extrusion die. The extrudate is then partially dried and the granulated in a spinning disc which bottom is machined to a "waffle iron" type surface and is stationary relative to the extrudate. The rim of the granulator is vertical and spins at a quite high rate of speed which effectively spheroidizes the extrudate. The primary difficulties with this equipment is the quality of the extruder which does very little delamination, deagglomeration, or mixing of the powder and the liquid, and the thinness of the extrusion die orifice. The result of these difficulties are the mixture is dilatant, even when a very plastic clay is used, which always produces poor final granule microstructure.

It is an object of this invention to provide an improved apparatus for the preparation of small spherical particles.

SUMMARY OF THE INVENTION

In accordance with this invention, there is provided a a delaminating, deagglomerating, mixing, extruding (DDME) apparatus for the direct plasticizing and extrusion of small diameter rods, or "spaghetti" shaped extrudate with excellent microstructure. This DDME apparatus preferably utilizes the principles of high compressive shear stresses at high shear rate between many interrupted flight augers and stationary stators within the mixing chamber to reduce any powder to its ultimate particle size and to uniformly mix any liquid and chemical additives homogeneously with the physically reduced powder.

The optimum microstructure extrudate is partially or fully dried and delivered to either one of two granulators and then to separators for classification of product. One granulator is a modification of an LCI Corporation design, and the other is a new apparatus that continuously machines the cylindrical extrudate to essentially monospheres.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 1A is a sectional view of breaker rollers 21;

FIG. 1B is a sectional view of granulating rollers 27:

DESCRIPTION OF THE PREFERRED EMBODIMENTS

Figure 1:
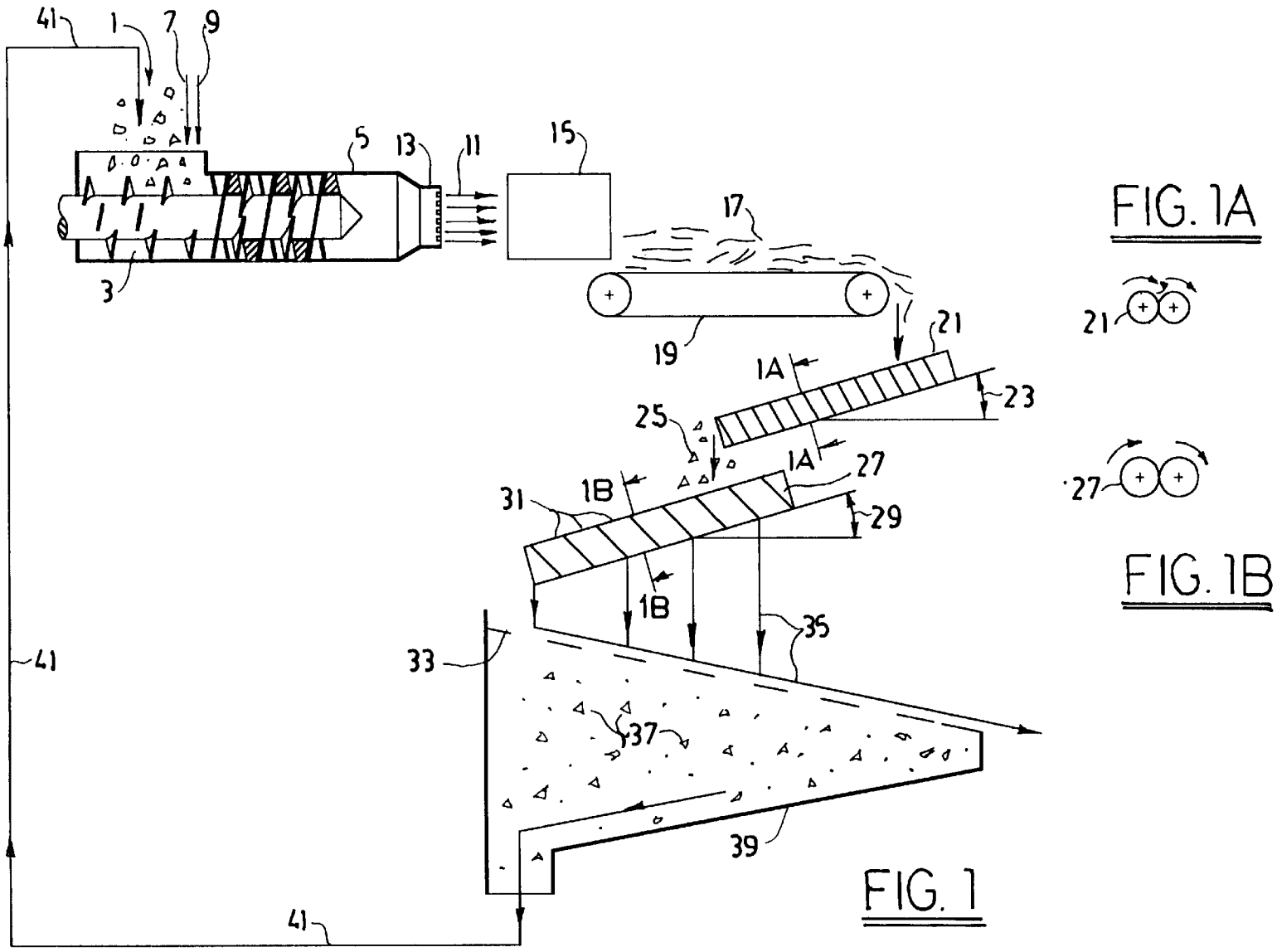
FIG. 1 is a schematic flow diagram of one preferred embodiment of the process for making spherical granules, wherein the raw materials are delaminated, deagglomerated, mixed with moisture and chemical additives, and extruded as small diameter cylindrical rods. These rods, similar in shape to "spaghetti", are completely dried and delivered to a pair of co-rotating rollers machined to cause the "spaghetti" to tumble and break to very short cylinders with an aspect ratio of approximately 1:1. The broken cylinders are then delivered to the next lower pair of rollers which are coated with an abrasive powder which machines them to a final spherical shape. The machined spheres are than delivered to a screen deck to separate the final product from dust and smaller fragments from the operation of the upper pair of rollers.

In this portion of the specification, applicant's preferred process will be described. Thereafter, applicant's preferred apparatus will then be described.

The preferred process of this invention is especially adapted for the manufacture of proppant. The manufacture and use of these proppants is well known to those skilled in the art. Thus, by way of illustration and not limitation, reference may be had to U.S. Pat. Nos. 5,420,174 (coated proppant), 5,411,091, 5,410,152, 5,404,010, 5,350,528, 5,330,005, 5,325,921, 5,281,023, 5,257,530, 5,265,729, 5,253,707, 5,199,491, 5,190,675, 5,165,479, 5,159,979, 4,977,116 (lightweight proppant), 4,944,905 (ceramic proppant), 4,921,810, 4,892,147 (refractory proppant), 4,852,650 (refractory proppant), 4,840,292 (oil well proppant), 4,817,717 (refractory proppant), 4,713,203 (bauxite proppant), 4,681,245, 4,680,266, 5,444,493 (aluminosilicate proppant), U.S. Pat. No. RE 34,371 (kaolin clay proppant), and the like. The disclosure of each of these United States patents is hereby incorporated by reference into this specification.

The preferred process of this invention preferably involves the use of a DMME apparatus. Dry or semi-dry material, plus the liquid medium, and chemical additives can all be added directly to the feed hopper of the mixer. The feed hopper contains pitched rotating blades to pre-mix the ingredients and propel them into the DDME (delaminating, deagglomerating, and mixing) chamber.

When they are inside the DDME chamber, the ingredients are subjected to very high shear stresses and shear rates.

The mixture thus produced may then optionally be passed through an attached vacuum chamber to remove air from the mixture which can cause weakening voids in the final product. The mixture is then expelled through one or more forming die orifice(s) or through a hinged exit door.

The extrudate is then partially or completely dried, depending on the subsequent operation.

The extrudate is then delivered to a granulator, which reduces the cylindrical product to a spherical product of a specific size.

The spherical granules are than delivered to a separating screen for final size classification and separation from grinding dust.

Dust from the process is collected in conventional dust collectors and returned to the DDME feed hopper as a raw material. Alternatively it may be slurried and the slurry added to the feed hopper, in addition to or instead of, the virgin liquid.

The selected spherical granules are then delivered to a final dryer and then to a calciner which converts them to hard, strong proppant for secondary oil and gas well recovery processes.

The DDME (Delaminator, Deagglomerator, Mixer, Extruder)

Conventional delamination and deagglomeration of clays and other powders at low liquid content is a high shear stress operation which uses a rotating continuous flight auger to force a very stiff, low liquid mixture through a die plate with small orifices. For example, the J. C. Steele Company (of Statesville, N.C.) produces such a machine. The only time the mixture experiences the high shear stress and high shear rate environment necessary for delamination and deagglomeration is as it enters and passes through the orifice plate. Very little work is performed on the mixture before it exits the orifice die. If the powder and liquid mixture has too much liquid, it extrudes through the orifices too easily and the powder does not experience sufficient shear energy to provide effective delamination and deagglomeration.

The DDME apparatus of this invention can be used as either a continuous or as a batch machine, but its use in the context of this invention is preferably continuous. It uses the rotary motion of an interrupted auger to both propel the mixture through the machine and simultaneously provide the necessary high shear stress-high shear rate environment to the mixture continuously during its travel through the machine. This is preferably accomplished by the three mechanisms discussed below.

Stators are preferably mounted between and very close to the interrupted auger segments. The auger rotates at high speed compared to a conventional continuous screw auger. This is possible because the openings in the interrupted augers allow back flow. As the auger segments propel the mixture forward, they also pinch it against the stators at high shear rate and therefore also at a high shear rate. Thus the mixture is delaminated and deagglomerated within the mixer rather than at its exit.

The forward pitch of the augers theoretically determines the output of the machine, but the terminal die orifice(s), reduces throughput and thus produces sufficient back pressure within the mixing chamber to cause substantial back flow between the auger segments. Because the feed rate into the mixing chamber is higher than the output rate from the mixing chamber, the mixture is under pressure within the mixing chamber. This pressure traps the mixture and all the particles and liquid within it and decreases its opportunity to escape from the high shear stress-high shear rate environment necessary for good delamination and deagglomeration. It also increases the residence time of the mixture within the high shear environment.

In addition to "pinch" between the sides of the augers and stators, the relatively high rotational speed of the auger produces a high impact zone between the leading edge of the auger and the stator face. This further decreases the opportunity for the mixture to escape the high shear energy. Thus, a plastic mixture with a high liquid content can still be effectively delaminated, deagglomerated, and mixed by increasing the rotational speed of the auger.

The combination of these three mechanisms assures that the mixture of powder, liquid, and chemical additions are delaminated and deagglomerated to their intrinsic smallest particles and are then mixed or blended together on a microscale significantly better than any other mixer presently available.

One result of this intense energy input, in addition to its primary purpose of delamination, deagglomeration, and mixing, is to raise the temperature of the mixture. Temperature control is essential for some mixtures such as for thermoplastic binder systems. A thermocouple attached to the chamber wall near the discharge end of the mixer can then provide an electronic signal to vary the speed of rotation of the augers via a variable speed drive. This temperature can also be modified by the addition of a cooling chamber surrounding the mixing chamber.

This mixer can also be incorporated with a vacuum system via an attached in-line, or separate, chamber to remove trapped air and excess moisture from the mixture between the mixing chamber and the extrusion orifice plate. Controlling the temperature and/or the vacuum can control the rate of moisture removal to partially dry the extrudate if necessary.

Since the raw materials used in this apparatus might not be beneficiated, they might contain some foreign materials such as stones too large to pass through very small orifices. These stones will, in time, plug the orifices and require that the entire mill be opened for their removal. This invention provides a means to remove most of these stones frequently simply by stopping the extruder and rotating a cleaning blade across the rear of the orifice plate. Immediately upstream of the orifice plate a rotating scraper is mounted for the removal of stones. Alternatively, a screen can be mounted several inches farther upstream from the orifice die to collect these stones. The screen can be removed for cleaning or replacement as necessary.

The high degree of delamination, deagglomeration and mixing combined with the vacuum removal of air provides a very compact microstructure in the extrudate which is the first requirement for maximizing the mechanical strength of the product.

The apparatus of this invention can accept extrudate after it has been dried to a hard friable condition. The small diameter extrudate at approximately 1:1 aspect ratio falls into the pinch angle between two parallel rollers rotating in the same direction, angled from the horizontal to encourage movement downward by gravity along the length of the rollers. The two rollers are adjustably separated from each other by the diameter of the desired spheres. Both rollers are machined and/or flame sprayed with an abrasive powder, to roughen their surfaces in such a way as to continually lift and roll the dry extrudate into small spheres, to then reduce their size, and finally to abrade them to the desired spherical size. As soon as each spherical granule reaches a diameter slightly smaller than the gap between the parallel rollers they fall through the gap, producing the final granule monosize.

Two preferred, continuous granulators are preferably comprehended in this invention.

In one embodiment, granulation of plastic or semi-plastic extrudate to narrow size distribution spheres is effected. The extrudate from the orifice die can be transferred directly, or after an additional brief drying period, to the bottom of a spinning cup with high sides. The sides of the spinning cup is roughened by machining or by flame spraying a coarse abrasive powder to force the cylindrical extrudate to tumble backward over themselves. At a specific moisture content the extrudate becomes quite stiff when the rough surface, tumbling it end over end as it spins and climbs the steep wall, breaks it to approximately the same length as its diameter. After breakage the small cylinders continue to tumble while rounding the ends of the cylinders transforming their shape to spheres. The size distribution depends upon the aspect ratio of the broken semi-dry cylindrical extrudate.

In another embodiment, granulation of dry extrudate to monosized spheres is effected. This apparatus can accept either the semi-dry spheres from the first method described above, or fresh extrudate after it has been dried to a dusting condition. The small diameter extrudate falls into the pinch, determined by the "nip angle", between two parallel rollers rotating in the same direction, angled from the horizontal to encourage movement downward by gravity along the length of the rollers. The two rollers are adjustably separated from each other by the diameter of the desired spheres. Both rollers are machined and/or flame sprayed by an abrasive powder, to roughen their surfaces in such a way as to continually lift and break the extrudate into small cylinders with an aspect ratio of approximately 1:1, to then reduce their size, and finally to abrade them to the desired spherical size. As soon as each spherical granule reaches a diameter slightly smaller than the gap between the parallel rollers they fall through the gap, producing the final granule monosize.

One preferred embodiment of the process of this invention is illustrated in FIG. 1. In this embodiment, and referring to FIG. 1, either a dry or wet powder 1 is fed into the feed hopper 3 of the DDME 5 (delaminator, deagglomerator, mixer, extruder) with the appropriate flow rate of polar or non polar liquid 7 and such chemical additives 9 deemed necessary to optimize the plasticity of the mixture. The mixture is continuously extruded as a plastic cylindrical "spaghetti" 11 through a single or multiple orifice die 13 and delivered to a dryer 15 to a hard compacted state. The dry "spaghetti" 17 is then delivered via any conventional conveyor system 19 to be broken into very short pieces with aspect ratio approaching 1:1 on the breaker rollers 21; as is known to those skilled in the art, an aspect ratio of 1:1 means the length of the broken cylinders is equal to their diameter.

In the preferred embodiment illustrated in the Figures, the breaker rollers 21 consist of one or more pairs of parallel rollers rotating in the same direction, separated by a gap as small as possible to prevent dry "spaghetti" fragments from exiting the rollers while still allowing the rollers to rotate freely. The breaker rollers 21 are preferably inclined at an angle 23 of about 5 to about 30 degrees from the horizontal. This allows the "spaghetti" to move downward toward the lower end of breaker rollers 21. The breaker rollers 21 also are preferably machined with grooves similar in shape to, or identical to, Acme threads.

As is known to those skilled in the art, an Acme thread (also often referred to as an "acme thread", or an "acme screw thread") is a standard thread having a profile angle of 29 degrees and a flat crest. It is described, e.g., in U.S. Pat. Nos. 5,349,992, 5,286,233, 5,265,980, and the like; the disclosure of each of these United States patents is hereby incorporated by reference into this specification.

Referring again to FIG. 1, the grooves may be single or multiple lead screws and they may be substantially smaller than the standard Acme thread design. The pitch direction of the "Acme" threads and rotation direction of the breaker rollers tend to move the "spaghetti" upward toward their feed end. Simultaneously the "spaghetti" is rotating in the valley between breaker rollers 21. This compound motion of rotating, tumbling over each other due to the opposing force of gravity moving them downward and the "Acme" threads moving them upward continually breaks the "spaghetti" into shorter and shorter lengths until they approach an aspect ratio nearly 1:1.

Referring again to FIG. 1, the short cylinders of the dry ceramic raw body 25 is delivered by gravity to another pair of granulating rollers. These rollers reduce the shape of the broken "spaghetti" 25 to spherical granules. The parallel granulating rollers 27 are separated by a gap which may be adjusted to about 1 to 3 micrometers diameter, which is the final diameter of the proppant product. These granulating rollers 27 are inclined at an angle 29 to the horizontal to cause the broken "spaghetti" to move downward along their length. Each roller is preferably coated with spiraling bands of an abrasive powder 31 pitched in the same direction as the "Acme" grooves of the breaker rollers 21. This abrasive coating causes the pieces to rotate continually and randomly while it abrades the corners of the cylinders into spherical granules. When the spherical granules are reduced to a size slightly smaller than the adjustable 0.5 to 3 millimeter gap between the rollers, they fall through the gap and are then delivered to a vibrating single deck screen 33 which separates the monosized spherical granules 35 from undersized granules, broken pieces, and dust 37 generated by the machining process. All the undersized material and dust from this machining operation is captured in a dust collection bin 39 and recycled 41 to the feed hopper 3 of the DMME 5 for replasticizing and mixing with virgin raw materials 1.

Figure 2A:
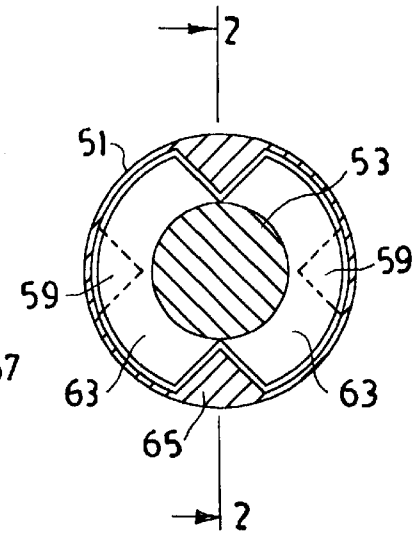
FIG. 2A is a sectional view of the apparatus of FIG. 2 taken along line 2A—2A.
Figure 2:
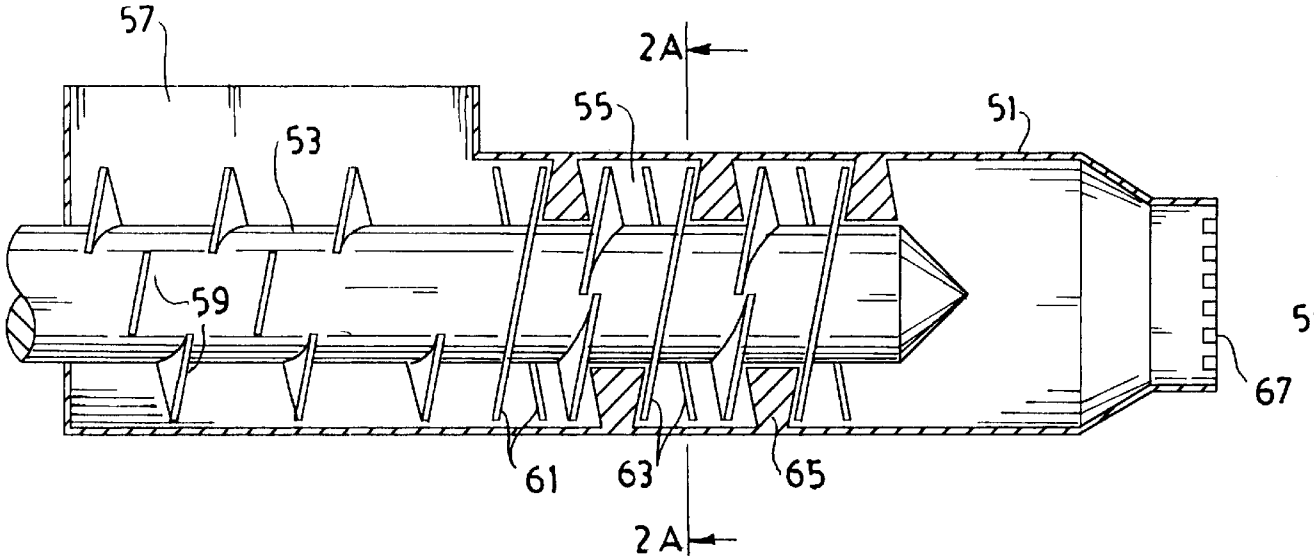
FIG. 2 is a schematic cross sectional view of the delaminator, deagglomerator, mixer, extruder of FIG. 1.

FIG. 2 is a schematic representation of a continuous or batch "DDME" mixer which is adapted to delaminate, deagglomerate, mix, and extrude ("DDME") a plastic mixture of powders which preferably contain polar or non polar liquids to a final extended length with a constant cross sectional shape; the mixer depicted may also be used to prepare precursors for subsequent reforming other shapes, as in injection molding, or the like. This apparatus may be used in almost any size, from less than about 1 horsepower to 100 or more horsepower. The primary principle of its operation requires that the mixer of this invention provides that the mixture is simultaneously under high compressive shear stress and high shear rate. These principles remain the same although the size and specific auger blade designs may vary according to the specific powder, liquid content, chemical additions, etc.

Referring to FIG. 2, it will be seen that the preferred apparatus is preferably comprised of a cylindrical machine 51 with a variable speed rotating central shaft 53 upon which are mounted different designed auger blades to serve different purposes, but always to propel the mixture forward through the machine. Material to be delaminated, deagglomerated, mixed and/or extruded is fed into the feed hopper 57 with appropriate plasticizers and liquids well known to those skilled in the art. The mass of material is conveyed by auger blades 59 which are pitched to provide a forward motion to the mixture of materials. The pitch on auger blades 59 should be at least twice the pitch on auger blades 61 and 63 because they have smaller frontal area and would convey too little material to the compression auger blades 61 and 63. It is desirable that feed auger blades 59 convey more material than compression auger blades 61 and 63 can accept.

Mixing chamber 55 contains larger face area interrupted auger blades 61 and 63 to propel the mixture forward toward a final orifice die 67. Orifice die 67 contains one or more openings through which the extrudate exits the mixing chamber, but the total area of all the holes in the die must be less than the cross sectional area between shaft 53 and apparatus wall 51 in order to provide significant back pressure within the mass of the mixture while it resides within the mixing chamber 55. This pressure provides that the mixture is subjected to very high shear stress at high shear rate which is the mechanics to obtain extremely good delamination, deagglomeration, and mixing.

Figure 3:
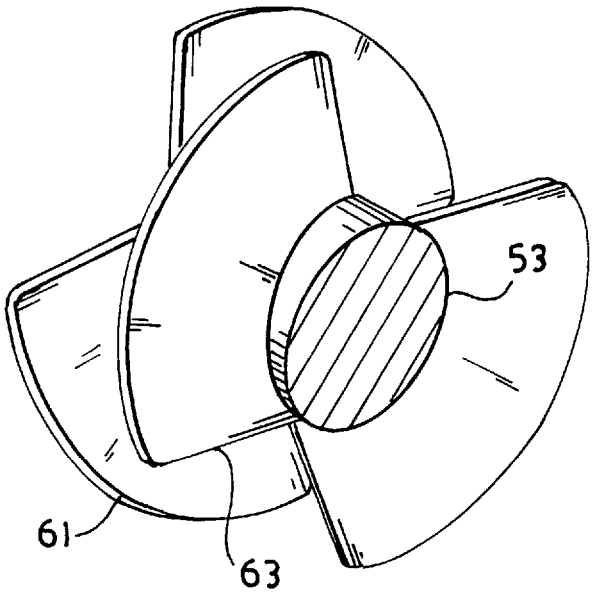
FIG. 3 is a view of two augur blades, one behind the other.

FIG. 3 is a perspective view of a preferred pair of auger blades 61 and 63, showing how the openings in the blades may be staggered to provide different paths for back flow of material in the mixing chamber.

Referring to FIG. 3, and in the preferred embodiment depicted therein, it will be seen that mixing chamber augers 61 and 63 have larger face area and smaller pitch than the feed augers 59 (see FIG. 2) and auger 61 has more pitch angle than auger 63 to assure adequate feed into mixing chamber 55. The larger face area on the mixing chamber augers provides more forward pressure on the mixture. Since the mixture cannot proceed toward the exit orifice die 67 as fast as it would with less back pressure, the openings in the augers allow back flow of the mixture through the openings. This back flow provides that the mixture is continuously being cut by the auger blades under high pressure. This further enhances the effectiveness of the mixer.

Referring again to FIG. 2, and in the preferred embodiment depicted therein, it will be seen that mixing chamber 55 also contains numerous stators 65 fastened to the wall of the mixing chamber 51 mounted less than about 4 millimeters (and preferably about 2 millimeters) from the revolving auger blades. The size and number of these stators depend upon the moisture content or stiffness of the plastic mixture being worked; the softer the mixture the larger and more numerous the stators would normally be. Each material run in this machine must be studied to determine the optimum operating conditions of the apparatus. The mixture is also pinched between the augers and stators which further increases local pressure and enhances the effectiveness of mixing. It has been found that these stators are very important to maximize the effectiveness of delamination and deagglomeration.

Since auger blades 61 and 63 in mixing chamber 55 are pitched forward to propel the mixture through the mixing chamber, these augers also can be used to extrude the mixture from the mixing chamber after mixing. For continuous extrusion the final orifice die may have a single hole or a multiplicity of holes, round, square, or any desired shape. For batch mixing the orifice die may be replaced with a hinged door well known to those skilled in the art, which can be opened after a suitable mixing time so the mixture may exit the mixing chamber.

In one preferred embodiment, in order to effect the purpose of this invention, the holes are circular and numerous. The criterion of their number and size is that the total open area of the holes must be less than or equal to the open area within the mixing chamber after subtracting the shaft and average blade area.

In one embodiment, not shown, the mixing apparatus 51 includes a vacuum chamber disposed after the mixing chamber to remove excess air and moisture from the mixture, thus further improving the microstructure of the extruded product. The mixture would then enter another, simpler auger system for final delivery from the entire apparatus.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A mixer for delaminating, deagglomerating, mixing, and extruding a mixture of powder and liquid, wherein said mixer is comprised of a mixing chamber comprised of an exterior wall and an interior wall, a variable speed rotating shaft disposed within said interior wall of said mixing chamber, a multiplicity of stators connected to said interior wall of said mixing chamber and extending from said interior wall towards said variable speed rotating shaft, a multiplicity of first auger blades connected to said variable speed rotating shaft and extending from said variable speed rotating shaft towards said interior wall of said mixing chamber, a multiplicity of second auger blades connected to said variable speed rotating shaft and extending from said variable speed rotating shaft towards said interior wall of said mixing chamber, and a multiplicity of third auger blades connected to said variable speed rotating shaft and extending from said variable speed rotating shaft towards said interior wall of said mixing chamber, wherein:

(a) said variable speed rotating shaft is comprised of a proximal section, a distal section, and an intermediate section disposed between said proximal section and said distal section;

(b) said first auger blades are connected to said proximal section of said variable speed rotating shaft, each of said first auger blades has a pitch which is at least twice as great as the pitch of each of said second auger blades, each of said first auger blades has a first face area, each of said second auger blades has a second face area, each of said third auger blades has a third face area and each of said first face areas is smaller than each of said second face areas and each of said third face areas;

(c) said second auger blades are connected to said intermediate section of said variable speed rotating shaft, wherein at least one of said second auger blades is disposed at a distance of less than about 4 millimeters from at least one of said stators; and (d) said third auger blades are connected to said distal section of said variable speed rotating shaft.

* * * * *